US006544055B1

(12) United States Patent
Branch et al.

(10) Patent No.: US 6,544,055 B1
(45) Date of Patent: Apr. 8, 2003

(54) ENHANCED MODULE KICK-OUT SPRING MECHANISM FOR REMOVABLE SMALL FORM FACTOR OPTICAL TRANSCEIVERS

(75) Inventors: Scott M. Branch, Rochester, MN (US); William K. Hogan, Rochester, MN (US); James E. Olson, Rochester, MN (US)

(73) Assignee: JDS Uniphase Corporation, San Jose, CA (US)

( * ) Notice: Subject to any disclaimer, the term of this patent is extended or adjusted under 35 U.S.C. 154(b) by 0 days.

(21) Appl. No.: 09/703,644

(22) Filed: Nov. 1, 2000

(51) Int. Cl.[7] ..... H01R 13/62
(52) U.S. Cl. ..... 439/159; 361/785
(58) Field of Search ..... 439/159, 152, 439/153, 154, 155, 157, 158, 700, 824; 361/785, 798; 446/150

(56) References Cited

U.S. PATENT DOCUMENTS

| | | | | |
|---|---|---|---|---|
| 3,968,784 A | * | 7/1976 | Miller | 124/27 |
| 4,981,277 A | * | 1/1991 | Elwell | 224/281 |
| 5,876,007 A | * | 3/1999 | Lancaster et al. | 224/281 |
| 5,944,240 A | * | 8/1999 | Honma | 224/281 |
| 5,980,324 A | | 11/1999 | Berg et al. | |
| 6,067,975 A | * | 5/2000 | Ginn | 124/59 |

OTHER PUBLICATIONS

Guide Rail and CAM System with Integrated Connector for Removable Transceiver, Ser. No. 09/216,104, filed Dec. 18, 1998, Jerry Berg, David P. Gaio and William K. Hogan.

Removable Latch and Bezel EMI Grounding Feature for Fiber–Optic Transceivers, Ser. No. 09/410,786, filed Oct. 1, 1999, Scott M. Branch David P. Gaio, and William K. Hogan.

Guide Rail and CAM System with Integrated Lock–Down and Kick–Out Spring for SMT Connector for Pluggable Modules, Ser. No. 09/391,974, filed Sep. 8, 1999, David P. Gaio, William K. Hogan, Frank Ovanessians and Scott M. Branch.

Guide Rail System with Integrated Wedge Connector for Removable Transceiver, Ser. No. 09/390,446, filed Sep. 7, 1999, Jerry Berg, David P. Gaio and William K. Hogan.

Guide Rail and CAM System with Integrated Connector for Removable Transceiver, United Ser. No. 09/441,248, filed Nov. 16, 1999, Jerry Berg, David P. Gaio and William K. Hogan.

* cited by examiner

*Primary Examiner*—Renee Luebke
*Assistant Examiner*—Phuong Chi Nguyen

(57) ABSTRACT

A spring-to-spring engagement of a kick-out spring and a secondary spring is disposed intermediate a structure supporting an electrical connector and an insertable and latchable electronic module or the like to enhance the disconnection and ejection of the module from the connector to which the module is connected. The spring-to-spring engagement insures both that adequate spring force is stored upon insertion and connection of the module and that disconnection and ejection forces are applied to the module. The forces are applied over a sufficient distance to fully displace the module from its latched position to its position of disconnection from the connectors and still provide spring force travel of the module to eject at least partially the module from the receiver or port into which the module was inserted and connected. A side benefit of the arrangement is that a high force is exerted on the module once it is unlatched for removal, and this high force will displace the module adequately to insure that the latch of the module does not relatch and to prevent removal of the module.

10 Claims, 8 Drawing Sheets

ENHANCED MODULE KICK-OUT SPRING MECHANISM FOR REMOVABLE SMALL FORM FACTOR OPTICAL TRANSCEIVERS

CROSS REFERENCE TO RELATED

UNITED STATES PATENT APPLICATIONS

The following United States Patent Applications contain disclosures of elements and devices which are related to the subject invention and are related United States Patent Applications:

- U.S. patent application Ser. No. 09/216,104, U.S. Pat. No. 6,074,228 filed Dec. 18, 1998, entitled GUIDE RAIL AND CAM SYSTEM WITH INTEGRATED CONNECTOR FOR REMOVABLE TRANSCEIVER, by Jerry Berg, David P. Gaio and William K. Hogan;
- co-pending U.S. patent application Ser. No. 09/410,786, filed Oct. 1, 1999, entitled REMOVABLE LATCH AND BEZEL EMI GROUNDING FEATURE FOR FIBER-OPTIC TRANSCEIVERS, by Scott M. Branch David P. Gaio, and William K. Hogan;
- co-pending U.S. patent application Ser. No. 09/391,974, filed Sep. 8,1999, entitled GUIDE RAIL AND CAM SYSTEM WITH INTEGRATED LOCK-DOWN AND KICK-OUT SPRING FOR SMT CONNECTOR FOR PLUGGABLE MODULES, by David P. Gaio, William K. Hogan, Frank Ovanessians and Scott M. Branch;
- U.S. patent application Ser. No. 09/390,446, U.S. Pat. No. 6,149,465 filed Sep. 7, 1999, entitled GUIDE RAIL SYSTEM WITH INTEGRATED WEDGE CONNECTOR FOR REMOVABLE TRANSCEIVER, a continuing application claiming priority of Ser. No. 09/215,977 U.S. Pat. No. 5,980,324 filed Dec. 18, 1998, entitled GUIDE RAIL SYSTEM WITH INTEGRATED WEDGE CONNECTOR FOR REMOVABLE TRANSCEIVER, by Jerry Berg, David P. Gaio and William K. Hogan, now U.S. Pat. No. 5,980,324, which issued Nov. 9, 1999;
- U.S. patent application Ser. No. 09/216,104, U.S. Pat. No. 6,074,228 filed Dec. 18, 1998, entitled GUIDE RAIL AND CAM SYSTEM WITH INTEGRATED CONNECTOR FOR REMOVABLE TRANSCEIVER, by Jerry Berg, David P. Gaio and William K. Hogan; and
- U.S. patent application Ser. No. 09/441,248, U.S. Pat. No. 6,142,802 filed Nov. 16 1999, which is a continuing application claiming priority of application Ser. No. 09/216,104, U.S. Pat. No. 6,074,228 above, entitled GUIDE RAIL AND CAM SYSTEM WITH INTEGRATED CONNECTOR FOR REMOVABLE TRANSCEIVER, by Jerry Berg, David P. Gaio and William K. Hogan

FIELD OF THE INVENTION

This invention relates to the field of electronic interconnections and, more specifically, the provision of the disconnection force and disconnection displacement required for reliable and automatic disconnection for small electronic modules or the like as well as at least partial ejection thereof whenever the modules are difficult to grasp while being unlatched and removed from a host receiving device.

BACKGROUND OF THE INVENTION

Increasingly, computers are being connected to other computers and servers using fiber-optic cable or coaxial cable. Efficient connecting or networking of the computers and servers requires the interchangeability of transceiver modules utilized to connect the coaxial or fiber-optic cable to the electronics of a computer or server. Interchangeability of transceiver modules is necessary both to accommodate those existing differences between the electrical signals carried over coaxial cable and the light pulse signals carried on a fiber-optic cable, and then to convert the signals between the electronic signals used by a computer and the optical signals carried on a fiber optic cable network.

U.S. Pat. No. 5,980,324, GUIDE RAIL SYSTEM WITH INTEGRATED WEDGE CONNECTOR FOR REMOVABLE TRANSCEIVER, issued Nov. 9,1999, to Jerry Berg et al., discloses one version of a kick-out spring in a transceiver port of a computer or server.

Currently being established is a standard for the interconnection interface and the transceiver modules to enable the various component suppliers of the devices to supply modules to be completely interchangeable without regard to manufacturing sources.

The transceiver modules typically are densely populated on an exterior panel of a computer housing or server housing and, accordingly, are difficult to grasp and extract from their respective ports, primarily due to size and spacing between adjacent ports. The difficulty of grasping the transceiver modules is exacerbated both by a very small surface of a fully inserted and latched transceiver module which protrudes from the computer or server housing, and the close proximity of similar adjacent modules does not allow adequate finger space to reach in order to grasp the modules.

It thus becomes necessary to eject the transceiver module, at least partially, from the computer housing or server housing once a transceiver module is unlatched. Typically, this is accomplished by one or more kick-out springs residing within the computer or server housing and generally within the electromagnetic interference shield that partially encloses the connector to which the transceiver module is engaged and connected. The kick-out springs are engageable by the transceiver module and compressed, deflected or deformed as the transceiver module is forced into a mating connection with the connector and latched for retention within the computer or server housing.

A transceiver module latch retains the transceiver module connected and installed with the computer or server electronics. Whenever this latch is released, the kick-out springs are intended to release their stored energy and restore to their undeformed state. This action pushes the transceiver module away from the mating connection to initiate disconnection from the connector in the computer or server.

This displacement of the transceiver module caused by the kick-out spring also moves the transceiver module and its latch mechanism, carried on the transceiver module, outward to the point that the latch cannot relatch, thus further retaining the transceiver module in a connected condition.

While the transceiver module protrudes a small distance from the computer or server housing in its fully latched and installed position, the small amount of the transceiver module protruding from the housing is difficult, if not insufficient, to be easily grasped by fingers in order to extract the transceiver module from the housing.

The amount of transceiver module extending from the housing is essentially the only visual indicator of connection or disconnection of the transceiver module with respect to the mating connector resident within the computer or server housing. If the module is not reliably seated and connected to the host connector, it may not be readily apparent based only on visual inspection.

Whenever the frictional forces of engagement and connection of the connector on the transceiver module with the connector resident within the host computer or server housing are excessive relative to the kick-out spring force, the transceiver module may not adequately respond to the unlatching of the transceiver module; and once the unlatching force is released, the latch may not have displaced sufficiently to prevent the latch from re-engaging the mating latch surface. Once this occurs, the transceiver module neither disconnects nor partially ejects from the computer or server housing as originally intended.

Under these circumstances, removal of a transceiver module requires connecting a dummy cable connector or similar device and pulling thereon while the latch is released again. This may overstress the cable or cable fitting and damage it to the point of being unusable. Alternatively, a tool must be secured and engaged with some portion of the transceiver module, and then the transceiver module must be forcibly pulled to disconnect the connectors and remove the transceiver module while simultaneously the module is latched. This procedure poses a substantial risk of damaging the transceiver module, a relatively expensive item.

The causes for improper and insufficient ejection of the transceiver modules may be due not only to excessive frictional forces between the connectors, but also due to insufficient deformation of the kick-out spring during insertion. Such insufficient deformation can result from a permanent set in the kick-out spring resulting in inadequate restoration movement and lack of adequate kick-out spring force over the entire range of movement required to fully disengage the mating connectors and to eject at least partially the transceiver module.

OBJECTS OF THE INVENTION

It is an object of the invention to insure reliable disconnection of a module from a host computer or server.

It is another object of the invention to insure the adequate displacement of the module to prevent relatching of the module in its connected, installed condition once unlatched for removal.

It is an additional object of the invention to provide a disconnecting and displacing force over an extended range of movement of the module.

It is a further object of the invention to insure displacement of the module sufficient to provide a ready manual grasp of the module for easy removal, upon unlatching and release.

The foregoing objects are not intended to limit the scope of the invention in any manner and should not be interpreted as doing so.

Other objects of the invention will become apparent to one of skill in the art of electrical connections and devices for accomplishing disconnection of electrical connectors with a full and complete understanding of the invention.

SUMMARY OF THE INVENTION

In order to overcome the frictional forces between the connectors of a computer/server and the transceiver module and then to eject the transceiver module from its port in the computer or server port, an ejection or kick-out spring is incorporated into a computer which engages and resists the insertion of the transceiver module. By deforming during insertion of the transceiver module, the kick-out spring stores energy which then is available to eject and disconnect the transceiver module upon release.

At least one version of this kick-out spring as discussed herein utilizes a pair of cantilevered beam springs supported by an electromagnetic interference shield, which at least partially encloses the connector of the host computer and into which the transceiver module is inserted. Due to size limitations, the kick-out spring is relatively weak and has a limited range of deformation before becoming over-stressed.

The range of motion through which a kick-out spring may be displaced or deformed is inherently limited by the design and choice of materials for the spring. The addition of an engaging secondary kick-out spring to the transceiver module structure enhances the disconnection and ejection. The secondary kick-out springs engage the primary kick-out springs and deflect in response to insertion of the transceiver module into the port. The combination of kick-out springs extends the effective range over which the disengagement or kick-out force is applied to the transceiver module. Moreover, the secondary springs can increase the initial kick-out force at the point of latch release. Latching mechanisms may be of varied types and may incorporate any such mechanism disclosed in any of the various cross-referenced related U.S. patent applications above.

The pair of cantilevered beam springs engage each other, and both deflect in direct relation to their respective spring force constants. These springs may be designed to provide the minimum disconnection force at a deformation equaling to and corresponding to force exerted at initial contact between the connectors of the computer or server and the transceiver module with no forced frictional engagement between the connector contacts or connector housings.

If the spring force constants of the opposing kick-out and secondary springs are substantially equal, both opposing springs will deform or deflect a substantially similar amount. If one of the opposing springs has a spring force constant greater than the other, the spring with the smaller spring force constant will deflect a greater amount than the spring with the larger spring force constant. The spring with the larger spring force constant may cause the other opposing spring to deform or deflect beyond its yield point and acquire a permanent set or deformation, thereby reducing its effectiveness and its ability to exert its design force on the opposing spring or, subsequently, it may cause the overly deflected spring to break.

To overcome this possible physical failure and prevent a reduction in effectiveness, the spring with the smaller spring force constant may be blocked at its maximum design limit of travel by an over-travel stop. The weaker spring will abut the over-travel stop when fully deflected by the stronger spring and the stronger spring then may continue to deflect as it is further loaded. This will permit the opposing springs to exert disconnection and ejection forces over a larger span of linear travel of the transceiver module and will insure that adequate ejection forces remain available from the kick-out springs to be exerted on the transceiver module once the transceiver module connector has been unlatched and disconnected from the mating connector.

The span of linear travel thus will be extended to be the sum of the deflections of the two opposing springs. Typically the weaker spring both will be formed integrally with the transceiver module and be molded of plastic. The stronger spring typically will be a metal spring and thus incorporated into the computer or servers. Additionally, it may be a part of or attached to a metal electromagnetic interference shield which at least partially encloses the computer connector of the port. The over-travel stops may be advantageously molded into the frame or chassis of the transceiver module.

Metal springs may be attached in conventional manner to the transceiver module chassis or frame if the use of integrally molded plastic springs is not desired. If metal, the transceiver module springs may be cantilevered leaf springs, collapsible leaf springs or coil springs as long as the other criteria set forth for the transceiver module springs are met.

This Summary of the Invention is intended to be only a summary and not be used to limit the invention in any manner.

A better and more complete understanding of the invention may be had from the attached drawings and the Detailed Description of the Invention that follows.

DETAILED DESCRIPTION OF THE PREFERRED EMBODIMENT OF THE BEST MODE CONTEMPLATED

BY THE INVENTORS FOR CARRYING OUT THE INVENTION

Figure 1:
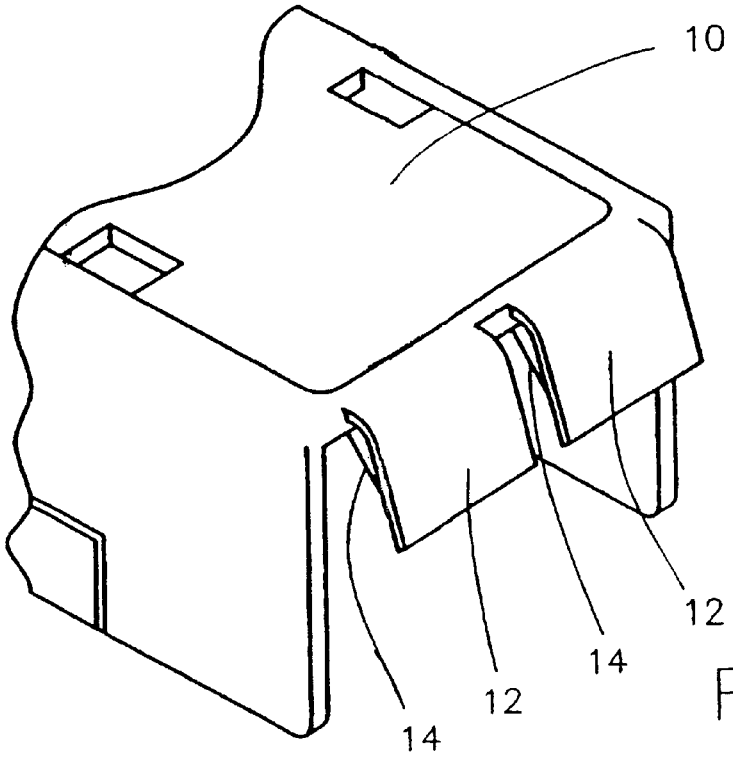
FIG. 1 is a rear isometric view of the transceiver module incorporating secondary kick-out springs.

Referring initially to FIG. 1, a portion of a transceiver module chassis 10 is illustrated showing two cantilevered spring members 12 integrally molded with the transceiver module chassis 10. It is preferred that two springs 12 be incorporated into the transceiver module chassis 10 in order to balance forces and symmetry; however, any number of such springs may be used so long as the forces exerted thereon and thereby do not create a binding condition within a port (not shown) for mounting a transceiver module 10.

Due to the resilient qualities of the moldable plastic, the springs 12 are deflectable or deformable under load and resilient. As is well known by those of skill in the art of plastic part design, the thickness of the springs, the dimensions of the attachment structure, the length of the cantilevered beam, and the characteristics of the materials from which the cantilevered beam and the transceiver module chassis are made will together determine the spring force constant of the springs. Similarly, the design and manufacture of molded plastic cantilevered beam springs is well-known and conventional.

The location of the free ends of the springs 12 relative to the transceiver module chassis 10 will be dependent upon the location of the ends of the kick-out springs 30 of the electromagnetic interference shield 32 (shown in FIG. 4) and which will be discussed more fully below. The ends of the springs 12 must be dimensioned in length to position the ends such that the ends of the kick-out springs 30 will engage the ends of springs 12 and act opposing each other.

An over-travel stop 14 is partially visible behind springs 12 and will be discussed more fully below.

Figure 2:
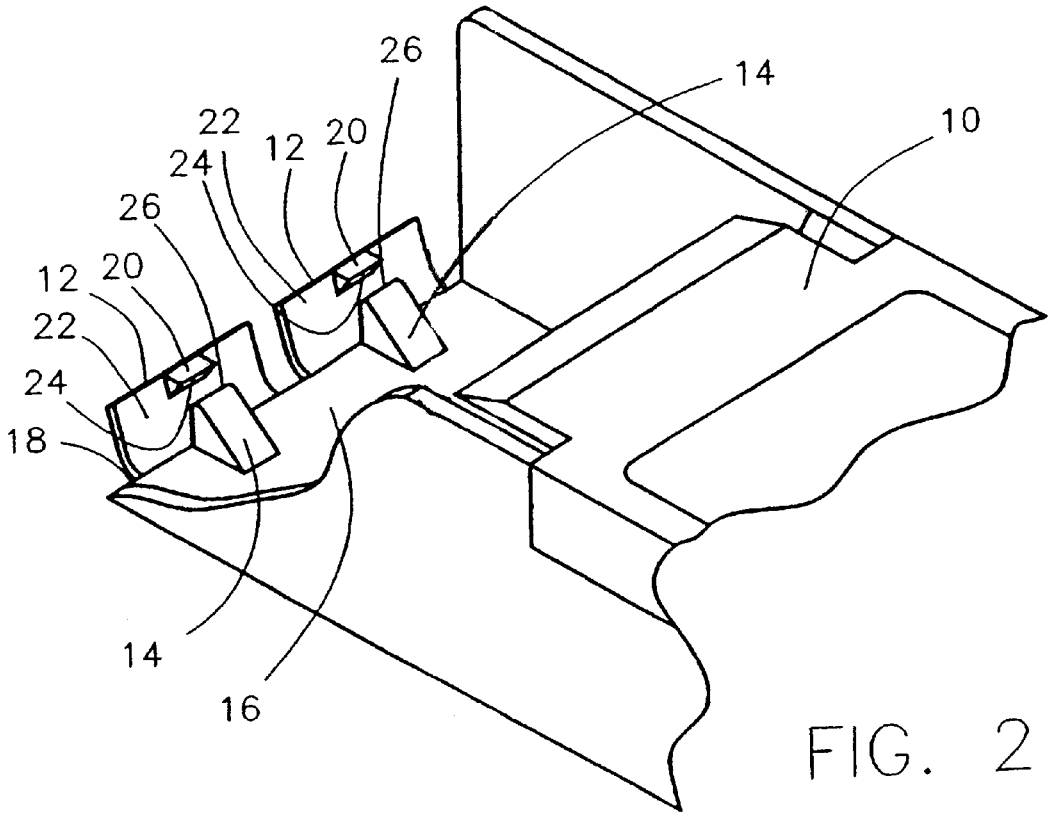
FIG. 2 is a bottom isometric view of the transceiver module incorporating secondary kick-out springs and over-travel stops.

With reference now to FIG. 2, the internal structure of the end of the transceiver module 10 is shown that includes a pair of over-travel stops 14 formed integrally with or rigidly disposed on the underside 16 of the top 18 of the transceiver module chassis 10. Springs 12 each are provided with projections 20 on the underside 22 thereof. The projections 20 may be considered supplemental over-travel stops or a part of an over-travel stop combination. Their purpose is to move engagement surfaces 26 to a location relative to the springs 12 where the over-travel stop 14 can be easily molded. Most plastics are subject to material creep whenever material loading limits are exceeded over time. The over-travel stops 14 and 20 associated with each spring 12 act to prevent excessive deformation of the springs 12 and thereby prevent inducing material creep or permanent deformation of either a portion of the spring 12 or the supporting portion of the transceiver module chassis 10. The projections 20 may be fashioned and shaped to engage with over-travel stops 14 by engaging edges of surfaces 24 with surfaces 26 of over-travel stop 14 which, due to the flexing of spring 12, will be substantially parallel at the occurrence of contact therebetween, providing stability of engagement.

Figure 3:
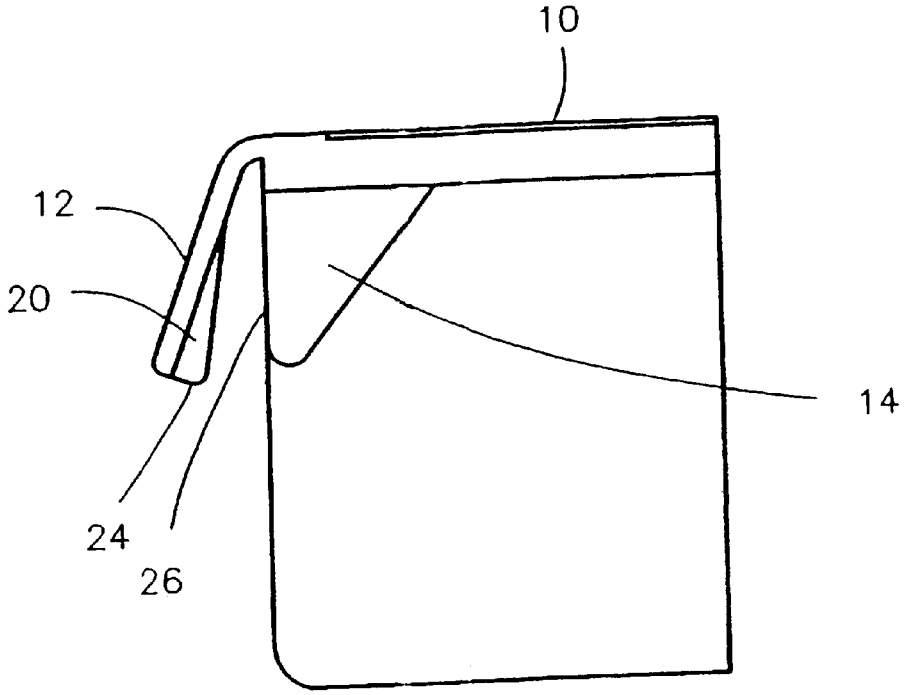
FIG. 3 is a side section view of the connector end of the transceiver module illustrating the form of one design of secondary springs and the over-travel stops thereon.

As may be observed in FIG. 3, the shape of the projection or over-travel stop 20 on a spring 12 lends itself to the previously described edge of surface 24-to-surface 26 engagement of projection 20 and over-travel stop 14. If the engagement of edges of surfaces 24 and surfaces 26 do not appear to be advantageous, then projections 20 may be shaped with only the limit of travel position of spring 12 determining the dimension of the projection 20 to prevent spring 12 from approaching surface 26 too closely.

Figure 4:
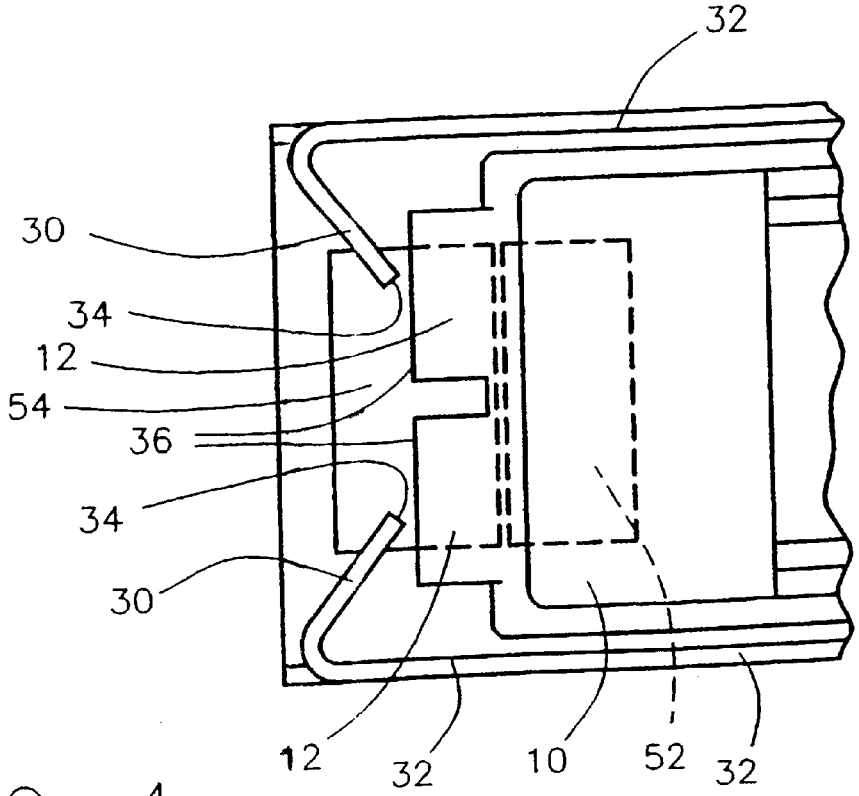
FIG. 4 is a top section view of the small form factor pluggable module cage and small form factor pluggable module cage springs with the transceiver module partially inserted therein.

FIG. 4 illustrates the relationship between the kick-out springs 30 of the host device 32. The kick-out springs 30 are formed from a portion of the same sheet of metal, typically steel, from which electromagnetic interference cage 32 is formed. The springs 12 are elongated tabs cut on three sides and attached to the electromagnetic interference cage 32 either by unsevered material at the fourth side or joining a tab by conventional means of attachment to the electromagnetic interference cage 32. The kick-out springs 30 thus are cantilever-supported by the structure of electromagnetic interference cage 32.

The distal ends 34 of the kick-out springs 30 are positioned to engage the end edge 36 of springs 12. The distal ends 34 of kick-out springs 30 should be free of burrs and smooth and preferably slightly rounded to ease relative movement between the distal ends 34 of springs 30 and the end edges 36 of springs 12 as deformation occurs in both springs 12, 30.

Figure 5:
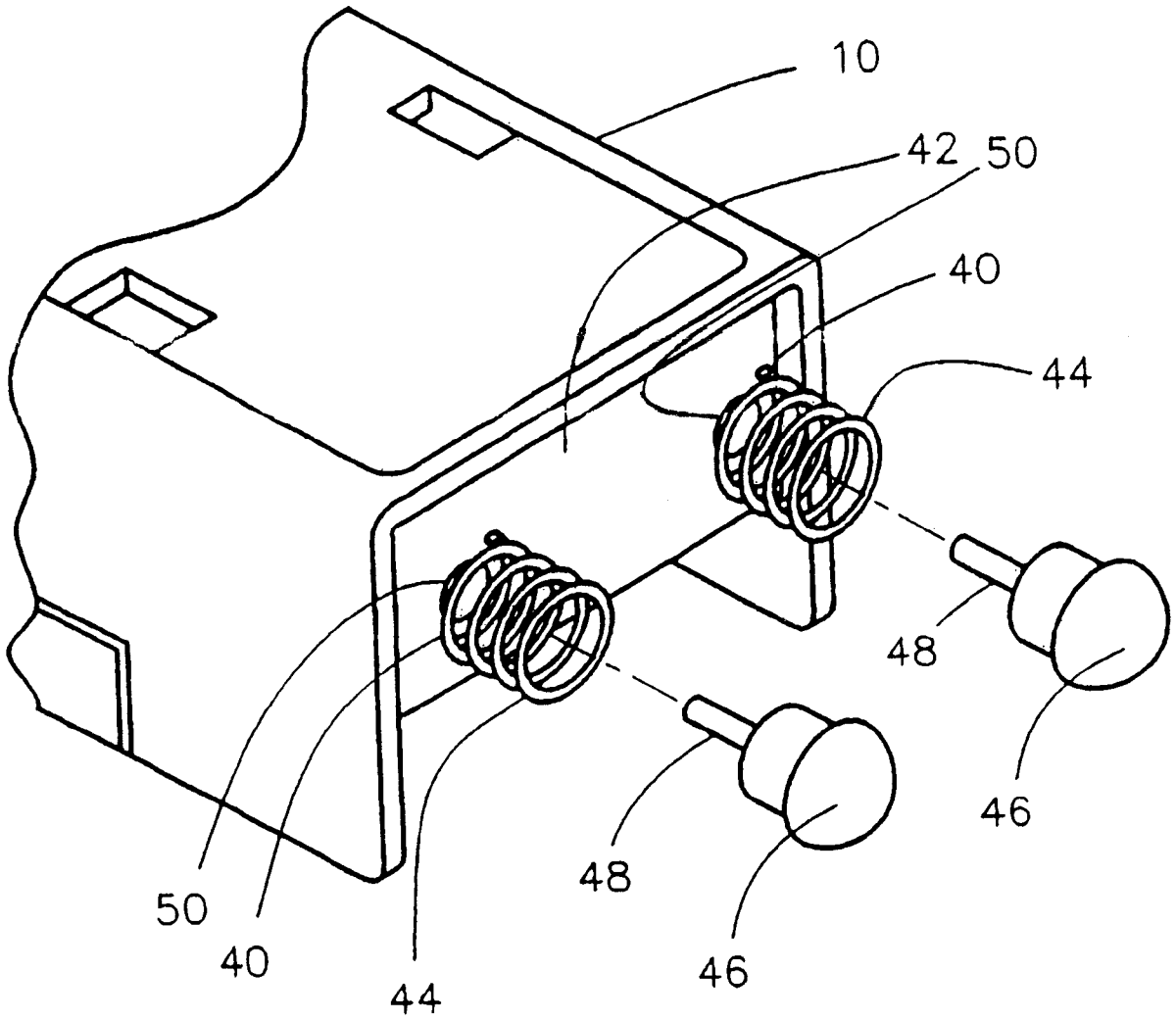
FIG. 5 is a rear isometric view of an alternative embodiment of the transceiver module and the secondary springs in the form of coil springs.

FIG. 5 shows an alternative embodiment of the invention showing the implementation of secondary springs using coil springs 40 for at least one of the pairs of springs. The transceiver module chassis 10 is shown having a coil spring 40 attached to a rear face 42 of the chassis 10. Although not illustrated here, the distal ends 44 of coil springs 40 may be adapted to engage a kick-out spring such as kick-out spring 30 shown in FIG. 4. The adaptation of the spring end 44 may be a plastic or other type plug 46 inserted into the distal end 44 of the coil spring 40 to confine to a very localized area the point of engagement of the spring 40 with kick-out spring 30. The plug 46 further may be provided with a core shaft 48 that can be inserted into a hole 50 through rear face 42 to further stabilize the spring 40 during compression.

FIG. 4 further illustrates in block form the connector on the host device 54 and the connector 52 on the transceiver module 10.

Again referring to FIG. 5, the columnar aspect ratio of the coil spring 40 must be relatively low in order to prevent column collapse. This may be accomplished by providing a relatively large diameter short spring, which inherently resists buckling better than a tall spring.

Additionally, the end 44 of the coil spring 40 or any insert therein if desired may be engaged with a surface modification on the kick-out spring 30. Such modification could a small dimple or depression or alternatively a localizing tab inserted into the open end of the coil spring 40 to localize the engagement of the kick-out spring 30 with the coil spring 40 and thereby prevent a significant shift in the effective spring arm length.

Whether they be cantilevered leaf, cantilevered molded or coil springs, the design considerations that must be considered with regard to springs encompass the amount of deformation/compression of a spring under load and the spring force constants of springs as well as the relationship of the force constants of a kick-out spring and the secondary springs 12,40.

The spring force constant of the kick-out spring 30 is preferably equal to or greater than the spring force constant of the secondary spring 12 or 40 on the transceiver module chassis 10. If there is equality in the spring force constants, then the deflection of each spring 12, 30, 40 will be substantially equal and the range of displacement of the transceiver module chassis 10 under spring force will be twice the deflection of one of the springs 12, 30, 40. However, if the spring force constant of one of the springs 12, 30, 40, preferably the secondary spring 12, is less than the spring force constant of the primary or kick-out spring 30, then the deflection of the secondary spring 12 will be greater at any stage of loading up to the point that the secondary spring 12 encounters a stop surface 26 of over-travel stop 14.

In this embodiment of the invention, the range of displacement of the transceiver module chassis 10 under spring force will be the sum of the deflection of the secondary spring 12 with a maximum deflection to the stop surface 26 of over-travel stop 14 plus the deflection of the kick-out spring 30. The combined deflections, whether equal or disparate, still must meet the criteria set forth below.

The combined deformation distances of the kick-out and supplemental springs, 30 and 12 respectively, should be greater than the displacement distance between initial engagement of the connectors 52, 54 and the fully seated and latched position of the transceiver module chassis 10. This can be accomplished by engaging the springs 12, 30 or 40, 30 prior to initial engagement of the connectors 52, 54.

Figure 6:
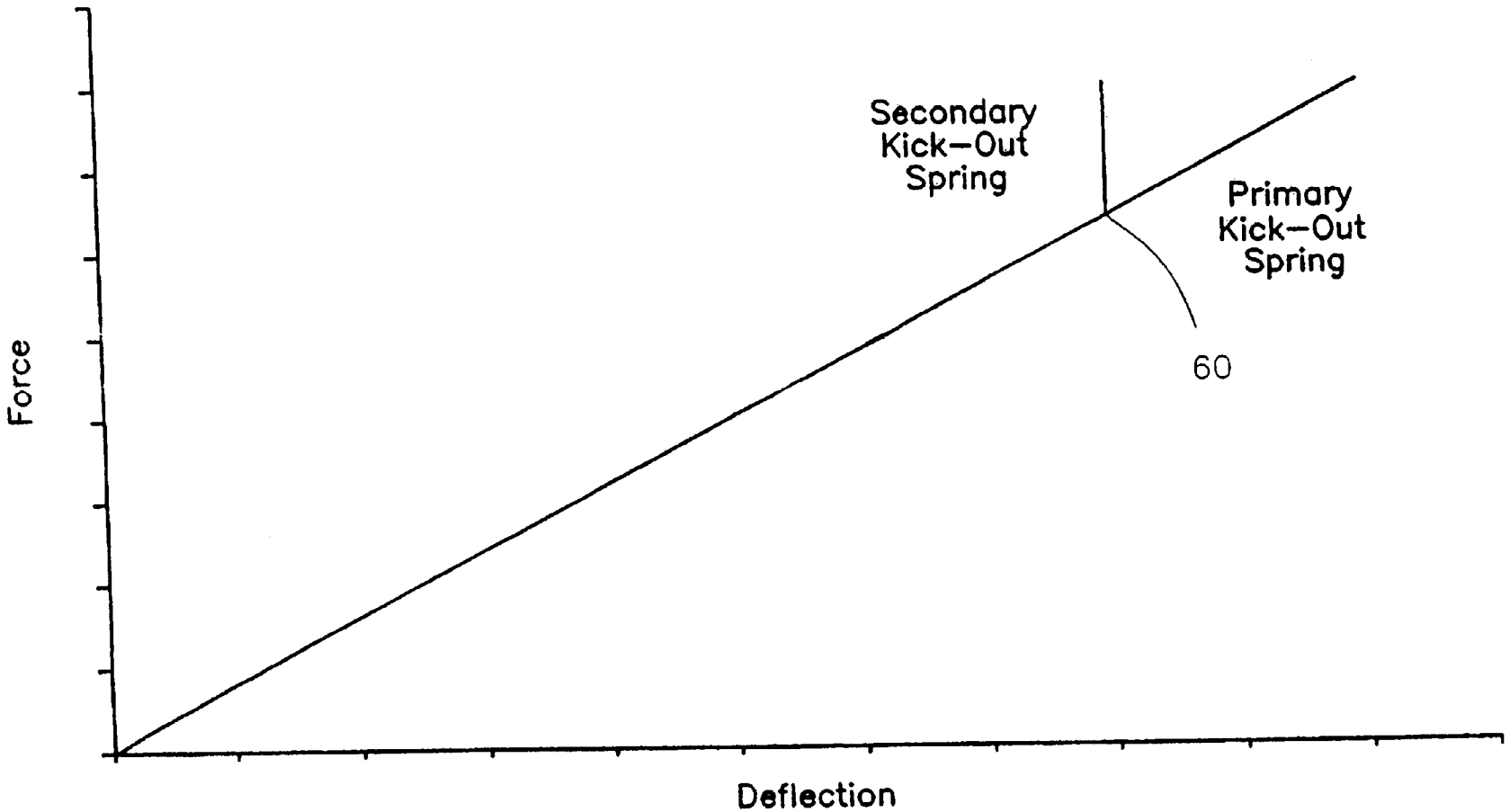
FIG. 6 is a graphical representation of the individual spring deflections versus loading over the range of movement of the transceiver module during insertion and engagement for springs having equal spring force constants.
Figure 7:
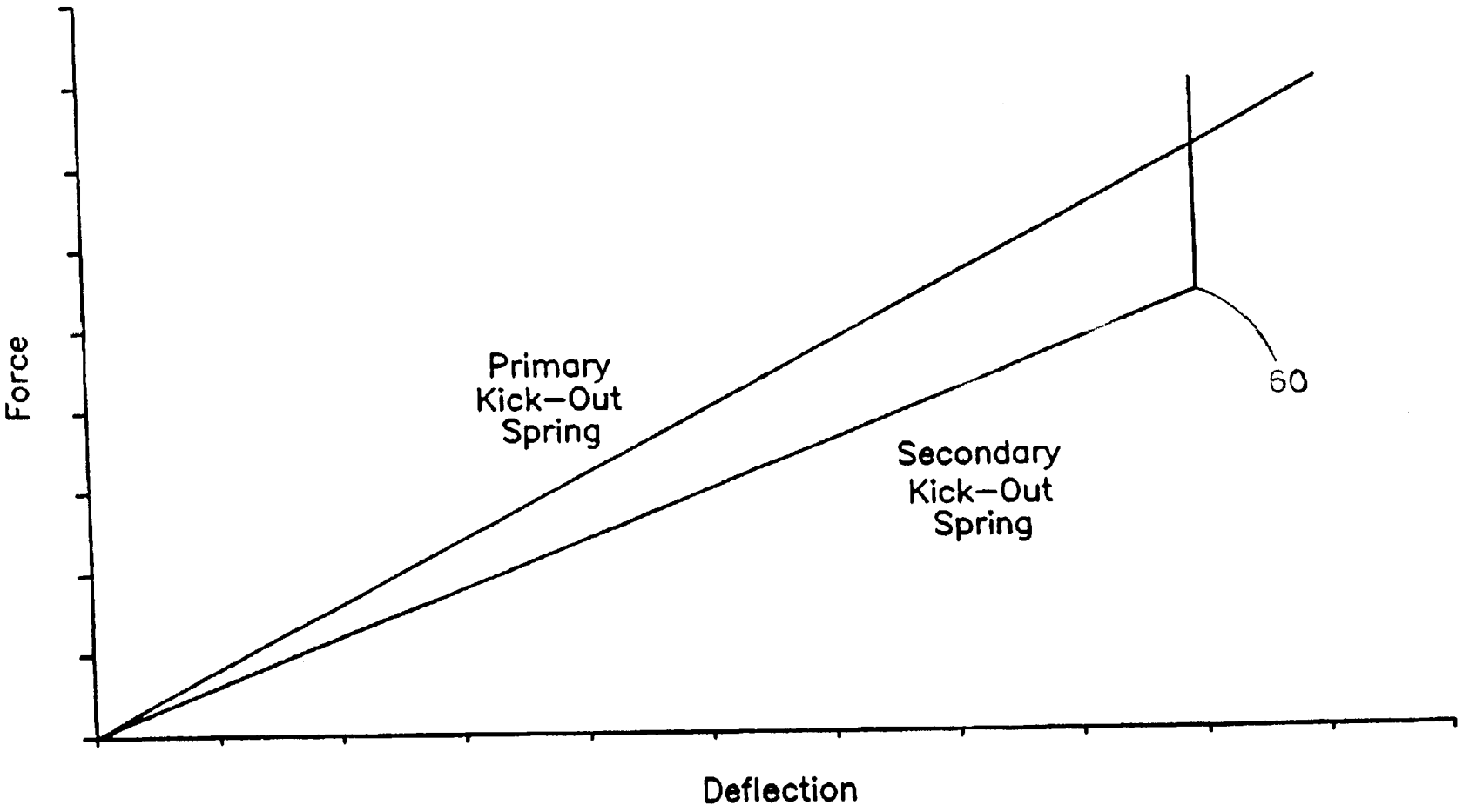
FIG. 7 is a graphical representation of the individual spring deflections versus loading over the range of movement of the transceiver module during insertion and engagement of springs where the secondary spring has a spring force constant smaller than the primary spring constant.
Figure 8:
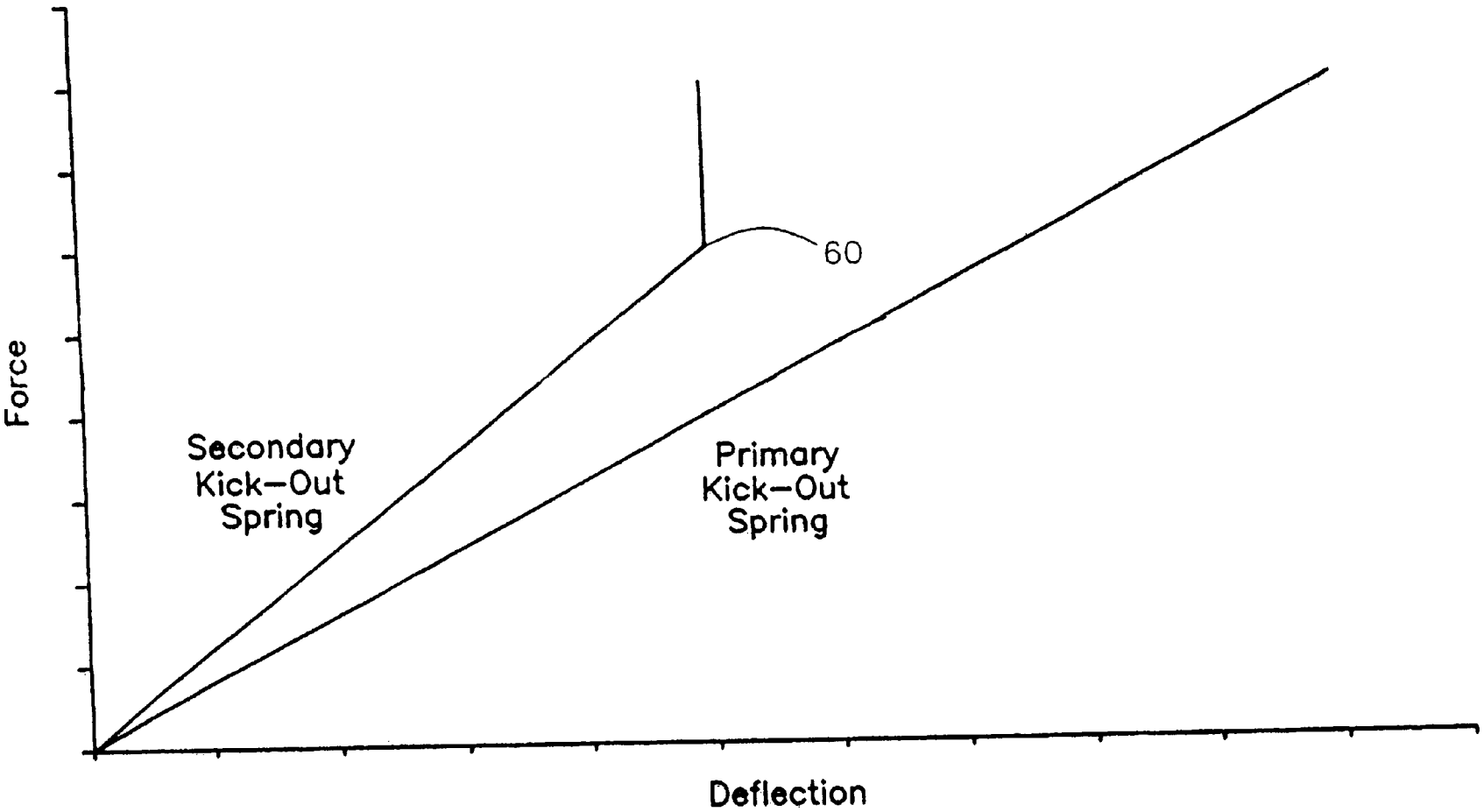
FIG. 8 is a graphical representation of the individual spring deflections versus loading over the range of movement of the transceiver module during insertion and engagement of springs where the primary spring has a spring force constant smaller than the secondary spring constant.

FIGS. 6, 7 and 8 are graphical depictions of the deflection of the springs 12, 30 or springs 30, 40 versus the loading of each spring 12, 30, 40. The knee in the curve for secondary spring 12, 40 occurs when the secondary spring 12 engages the over-travel stop 14, and secondary spring 30 no longer continues to contribute a spring force greater than the spring force exerted at over-travel stop engagement. Where the secondary spring 40 compresses until it forms a solid column, the knee 60 represents the deflection of the spring 40 at the point where the coil spring 40 becomes a solid column and no longer deflects. At the point where the secondary spring 12 or spring 40 will no longer deflect under additional loading, the secondary spring 12, 40 becomes the equivalent of a solid body and ceases to act as a spring.

FIG. 6 is representative of an embodiment of the invention where the spring force constants of both springs 12, 30 are equal. The spring force exerted by the kick-out spring 30 and the spring force exerted by the secondary spring 12, 40 increase at a constant and equal rate until secondary springs 12, 40 engage a stop. Thereafter, the spring force increases solely in response to additional deflection of the kick-out spring 30.

FIG. 7 is representative of an embodiment wherein the spring force constant of the kick-out spring 30 is larger than the spring force constant of the secondary spring 12. The spring force exerted by the kick-out spring 30 and the spring force exerted by the secondary spring 12, 40 increase at unequal but constant rates until secondary springs 12, 40 engage a stop. Thereafter, the spring force increases solely in response to additional deflection of the kick-out spring 30.

FIG. 7 is representative of an embodiment wherein the spring force constant of the kick-out spring 30 is smaller than the spring force constant of the secondary spring 12. In FIG. 8, the spring force exerted by the kick-out spring 30 and the spring force exerted by the secondary spring 12, 40 increase at a constant but unequal rates until secondary springs 12, 40 engage a stop. Thereafter, the spring force increases solely in response to additional deflection of the kick-out spring 30.

Figure 9:
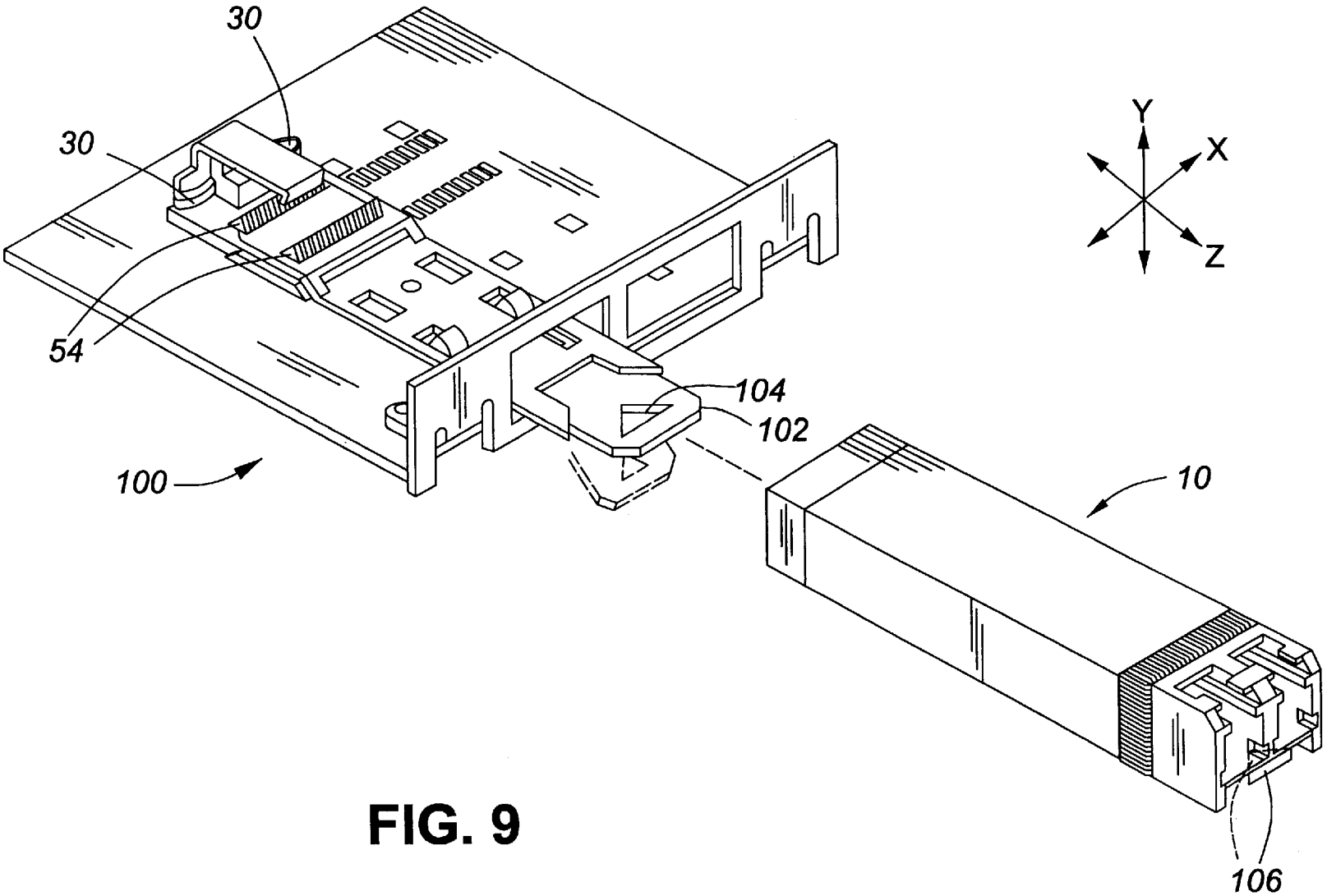
FIG. 9 is an isometric illustration of a transceiver module chassis and a receiving host device, further illustrating a latch on the host device.

Referring now to FIG. 9, the host device 100 illustrates the mounting of connectors 54 which engage connectors 52 (FIG. 4) on the transceiver module chassis 10. Transceiver module chassis 10 mates with the host device 100 and engages kick-out springs 30 on the host device 100.

Latch 102 extends from the host device 100 and forms a latch opening 104. Latch opening 104 circumscribes and engages latch member 106 on transceiver module chassis 10 to retain transceiver module chassis 10 inserted within host device 100.

Figure 10:
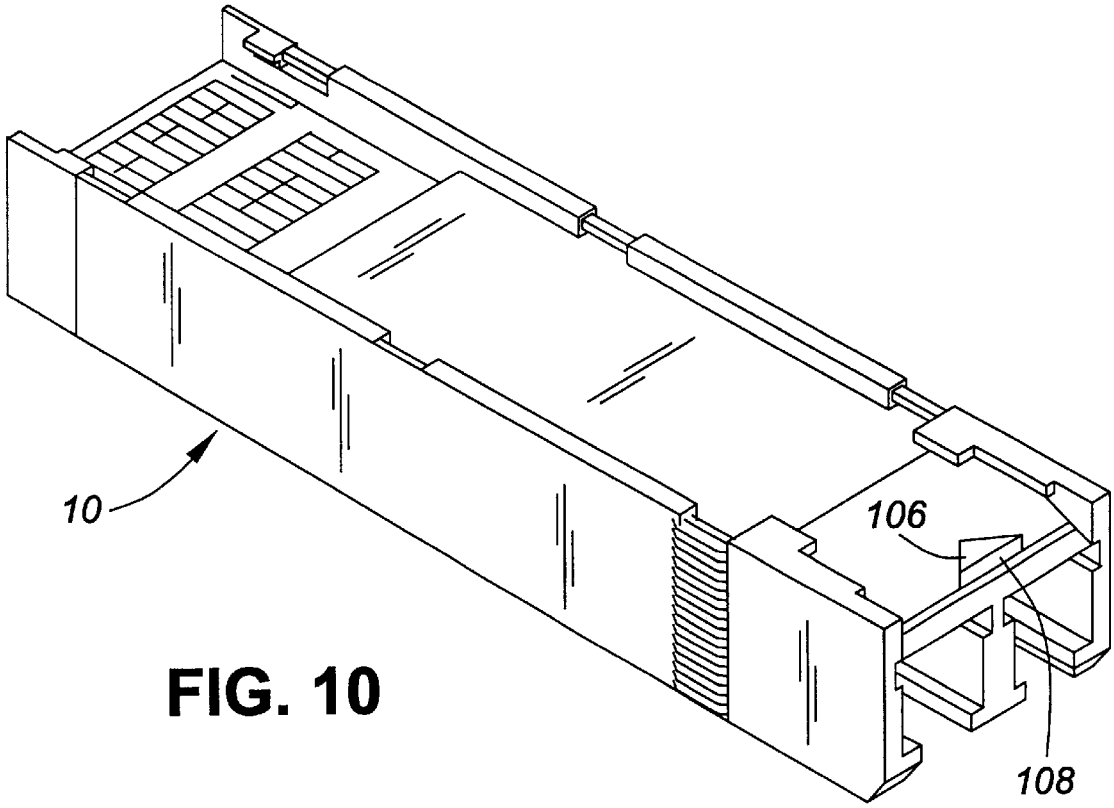
FIG. 10 is a bottom isometric view of a transceiver module having a latch structure and latch surface as a portion thereof.

In FIG. 10 the transceiver module 10 is displayed to show the latch member 106 protruding form the bottom thereof. Latch surface 108 is a surface of latch member 106 which engages latch 102 of FIG. 9. The latch 102 keeps the transceiver module 10 engaged with the kick out springs 30 of the host device 100 and connectors 52, 54 connected.

The primary kick-out spring 30 may take one of various forms (not all shown). It may be mounted on the circuit board to which the host connector is attached, be a part of the electromagnetic interference cage, be a part of the host connector assembly, be part of a guide rail system, or be part of any other technique for rigidly mounting the fixed end of the primary kick-out springs within the electromagnetic interference cage to engage the secondary kick-out springs as described above. Similarly, the primary kick-out spring may be implemented as coil springs acting against cantilevered secondary kick-out springs on the transceiver module.

Other aspects, changes and modifications may become known and understood by anyone of skill in the art and such aspects or modifications are considered a part of the invention and not a removal of the modified device from the scope of the invention as claimed below.

This description is made for purposes of full disclosure and enablement and is not intended to limit the invention in any manner. The scope of the invention is defined by the appended claims.

What is claimed is:

1. A module disconnection and ejection apparatus for disconnecting and ejecting an electronic module from a host electronic device comprising:

an electronic connector disposed within and aligned with a port of said host electronic device for receiving and connecting to said electronic module;

a latching surface disposed within said receiving electronic device;

an electronic module, said module insertable into and retainable within said port and comprising a mating connector for connection with said electronic connector disposed within said receiving electronic device;

a latch mechanism on said module engageable with and latchable to said latching surface;

at least a first deformable resilient member projecting into interference with said module, said member disposed to engage said module at predetermined locations;

at least a second deformable resilient member projecting from said module into a position engageable with said first resilient member, each said resilient member deformed upon insertion of said module against deformation resistance forces generated by said insertion until said each member latches with said latching surface, and whereby said module is spring-loaded to disconnect and displace a distance sufficient to prevent relatching of said module upon release of said latch.

2. The module disconnection and ejection apparatus of claim 1 wherein said first and second cantilevered members each comprise a pair of cantilevered members, each said cantilevered member of each said pair having a substantially equal spring force constant and one of said pairs having spring force constants less than said spring force constants of said other pair, and said apparatus further comprising an over-travel stop associatingly disposed in a path of deformation of each cantilevered member having a lesser spring force constant, said over-travel stop fixed in said path of deformation.

3. The module disconnection and ejection apparatus of claim 1 wherein said first pair of cantilevered members projects from and is supported by a structure at least partially surrounding said module and fixed relative to said port.

4. The module disconnection and ejection apparatus of claim 1 wherein said first deformable resilient member is a cantilevered member disposed and supported within said host electronic device and said second deformable resilient member is another cantilevered member disposed on and supported by said module.

5. The module disconnection and ejection apparatus of claim 4 wherein said module further comprises at least one over-travel stop aligned with said at least one second cantilevered member, thereby preventing damage to said second cantilevered member.

6. The module disconnection and ejection apparatus of claim 5 wherein said at least a first and a second cantilevered members each comprise a plurality of cantilevered deformable resilient members, each of said first and second cantilevered members having a spring force constant.

7. The module disconnection and ejection apparatus of claim 6 wherein said spring force constants are substantially equal.

8. The module disconnection and ejection apparatus of claim 6 wherein said force constants of said second cantilevered members are smaller than said force constants of said first cantilevered members.

9. An extended displacement ejection apparatus for at least partially ejecting an insertable device from a by, receiving device comprising:

a first deformable means for storing energy disposed within said receiving device; and a second deformable means for storing energy disposed on said insertable device and engageable with said first means for storing energy and deforming upon insertion into said receiving device;

wherein each of said first and second deformable means for storing energy deform within a predetermined range of deformation, and wherein said first and second means for storing energy restore upon release to substantially an undeformed state, thereby providing a displacement of said insertable device substantially equal to or greater than the combined deformations of the first and second means for storing energy, wherein said first means for storing energy has a spring force constant of a first magnitude, and said second means for storing energy has a spring force constant of a second magnitude, which is less than said first magnitude;

wherein said second means for storing energy further comprises a means for limiting deformation of said means for storing energy.

10. The extended displacement ejection apparatus of claim 9, further comprising latching means for exerting a latching or retaining force for holding the insertable device in the receiving device; wherein said spring force constant of said first magnitude multiplied by deformation exceeds any forces retaining said insertable device within said receiving device except the latching or retaining force exerted on said insertable device.

* * * * *

UNITED STATES PATENT AND TRADEMARK OFFICE

CERTIFICATE OF CORRECTION

PATENT NO. : 6,544,055 B1
DATED : April 8, 2003
INVENTOR(S) : Branch et al.

It is certified that error appears in the above-identified patent and that said Letters Patent is hereby corrected as shown below:

Column 10,
Line 24, "from a by, receiving device" should read -- from a receiving device --

Signed and Sealed this

Fifteenth Day of July, 2003

JAMES E. ROGAN
*Director of the United States Patent and Trademark Office*